US006834596B2

(12) United States Patent
Kerber

(10) Patent No.: US 6,834,596 B2
(45) Date of Patent: Dec. 28, 2004

(54) RETAIL STORE CHECKOUT ASSEMBLY, POINT-OF-SALE EQUIPMENT STAND, AND ARRANGEMENTS

(76) Inventor: Philip S. Kerber, 2688 30th Ave., Osceola, WI (US) 54020

( * ) Notice: Subject to any disclaimer, the term of this patent is extended or adjusted under 35 U.S.C. 154(b) by 23 days.

(21) Appl. No.: 10/138,745

(22) Filed: May 3, 2002

(65) Prior Publication Data

US 2002/0189502 A1 Dec. 19, 2002

Related U.S. Application Data

(60) Provisional application No. 60/289,018, filed on May 4, 2001.

(51) Int. Cl.[7] ..... A47B 37/00

(52) U.S. Cl. ..... 108/42; 312/140.4

(58) Field of Search ..... 248/274.1, 176.1, 248/178.1, 518; 108/42, 147.11, 147.17, 92, 93, 97, 50.02, 150; 312/140.1, 140.4; 186/61, 59

(56) References Cited

U.S. PATENT DOCUMENTS

| | | | | | |
|---|---|---|---|---|---|
| 1,915,727 | A | * | 5/1933 | Friedemann | 248/243 |
| 2,418,067 | A | | 3/1947 | Carpemter, Sr. | |
| 3,700,074 | A | | 10/1972 | Shoffner | |
| 3,730,469 | A | | 5/1973 | Shields | |
| 4,401,189 | A | | 8/1983 | Majewski | |
| 4,618,032 | A | | 10/1986 | Woolf | |
| 4,619,427 | A | | 10/1986 | Leymann | |
| 4,632,349 | A | * | 12/1986 | Anstey | 248/281.11 |
| 4,687,166 | A | | 8/1987 | Poehler | |
| 4,789,048 | A | | 12/1988 | Cramer et al. | |
| 4,838,383 | A | | 6/1989 | Saito et al. | |
| 4,953,664 | A | | 9/1990 | Vrooman et al. | |
| 4,963,721 | A | | 10/1990 | Kohno et al. | |
| 5,019,694 | A | | 5/1991 | Collins, Jr. | |
| 5,037,162 | A | * | 8/1991 | Ransom | 312/236 |
| 5,039,051 | A | | 8/1991 | Umebara et al. | |
| 5,082,037 | A | | 1/1992 | Hammons et al. | |
| 5,183,135 | A | | 2/1993 | Kurimoto et al. | |
| 5,207,294 | A | | 5/1993 | Kurimoto et al. | |
| 5,390,764 | A | * | 2/1995 | Kerber | 186/68 |
| 5,412,193 | A | * | 5/1995 | Swartz et al. | 235/383 |
| 5,853,322 | A | * | 12/1998 | Jones et al. | 453/63 |
| 5,967,263 | A | * | 10/1999 | Ariga | 186/59 |
| 2003/0155418 | A1 | * | 8/2003 | Daugs et al. | 235/383 |

FOREIGN PATENT DOCUMENTS

| | | | |
|---|---|---|---|
| JP | 135998 | * | 11/2001 |

* cited by examiner

*Primary Examiner*—Janet M. Wilkens
(74) *Attorney, Agent, or Firm*—Merchant & Gould P.C.

(57) ABSTRACT

A checkout stand assembly for use with a counter-top or conveyor belt point-of-sale checkout station. The checkout stand assembly includes a podium that can support a cash drawer, printer, keyboard, and other such peripheral equipment. The podium can then be mounted onto a floor, counter, railing, or other object, and is positioned between the cashier and the customer. The podium positions the cash drawer and all point-of-sale equipment in an area close to or above the bar code scanner.

11 Claims, 5 Drawing Sheets

RETAIL STORE CHECKOUT ASSEMBLY, POINT-OF-SALE EQUIPMENT STAND, AND ARRANGEMENTS

Priority under 35 U.S.C. § 119(e) is claimed to provisional application Ser. No. 60/289,018, filed on May 4, 2001, and entitled "Retail Store Checkout Assembly, Stand and Arrangements". The complete disclosure of application 60/289,018, is incorporated by reference herein.

FIELD OF THE INVENTION

The present invention relates to retail store checkout stands, and more specifically, to checkout stands having a podium for any peripheral equipment and including the cash drawer, the podium being positioned in close proximity to a barcode scanner.

BACKGROUND OF THE INVENTION

Anyone who has been in a retail store is familiar with the checkout stand; the checkout stand is where one pays for the selected items. Checkout stands, also commonly referred to as checkstands, can be arranged in a broad variety of configurations. Many checkout stands, such as conveyor belt checkout stations, typically have the cash drawer and keyboard mounted perpendicular to the conveyor belts; that is, the drawer of the cash drawer moves parallel to the conveyor belts. This allows the cashier to see the customers waiting in line and to view the items as they progress down the conveyor belt toward the bar code scanner. Although this position may be convenient to see the progressing items, in order to scan the items, the cashier must at least partially turn to pass the items in front of the scanner. Additionally, in order to see the customer whose order is being scanned, who has now moved farther down the lane or downstream, and is typically standing close to the scanner, the cashier must turn their entire body farther, or else turn their neck, creating the possibility of straining their neck or back. Once the scanning is completed, the cashier must either rotate their body 90 degrees, or reach in an uncomfortable and non-ergonomical fashion to reach the cash drawer and keyboard. Some cashiers stand facing the customer. However, this position still requires rotating their body 90 degrees to reach the cash drawer and keyboard.

Attempts have been made to provide a checkout station that has checkout equipment or peripherals, such as the register keyboard and credit card swipe and pin pad machine, positioned above, or at least aligned with, the scanner. This minimizes, and preferably eliminates, the twisting and turning of the cashier to access the keyboard, typically a multitude of times during the scanning process. Because of the size limitations and adequate support structure needed to accommodate the weight of and movement of the cash drawer, the cash drawer has heretofore defied being located above the scanner, totally accessible to the customer-facing cashier.

One attempt to solve this is disclosed in U.S. Pat. No. 5,390,764 Kerber), which has a check writing area positioned opposite a keyboard stand area.

What is desired is a compact arrangement that allows accessibility to peripheral equipment and provides a configuration that is friendly and convenient to both the customer and cashier.

SUMMARY OF THE INVENTION

The present invention is directed to a store checkout stand and podium for use therewith. The present invention can be used with a conveyor belt system of one to three belts, or with a checkout station that simply uses a counter. The assembly of the present invention provides the cash drawer, register keyboard, printer, and other point-of-sale or peripheral equipment located on the podium above the barcode scanner. This podium can be mounted onto a counter, floor, or onto a siderail or sidewall of the counter housing the conveyor belt system.

In one aspect, the invention is to a podium for a store checkout stand, the podium having a top (or topper) for mounting checkout equipment thereon and a support structure. The support structure has a leg and a top support structure, with the leg extending from a mounting surface to the topper, and the leg having a passage therethrough. The top support structure is connected to the leg and provides support for the topper or top. Peripheral checkout equipment, such as a cash drawer, keyboard, printer, and the like is positioned on the topper.

In another aspect, the invention is to a podium assembly for a store checkout stand, the podium assembly including a podium for supporting point-of-sale checkout equipment, including a cash drawer, and a cable management system. The podium and cash drawer each has a passage therethrough, the passages being aligned when the cash drawer is operably positioned on the podium. The assembly further has a cable manifold system, positioned proximate the cash drawer, on the side opposite the stand. Together, the passages and cable manifold form a cable management system for accepting lengths of cables or wires therethrough.

The podium is mounted between the cashier and the customer, above or in close proximity to the bar code scanner. By positioning the podium in a location in front of the cashier when the cashier is facing the customer, twisting and turning of the cashier is minimized and the cashier's movements are better optimized. The checkout process is more efficient. Additionally, having the cash drawer on the podium in front of the cashier increases the security of the cash drawer.

Other podium constructions, checkout stands incorporating the podium, and other features, are disclosed.

DETAILED DESCRIPTION OF THE PREFERRED EMBODIMENT

Figure 2:
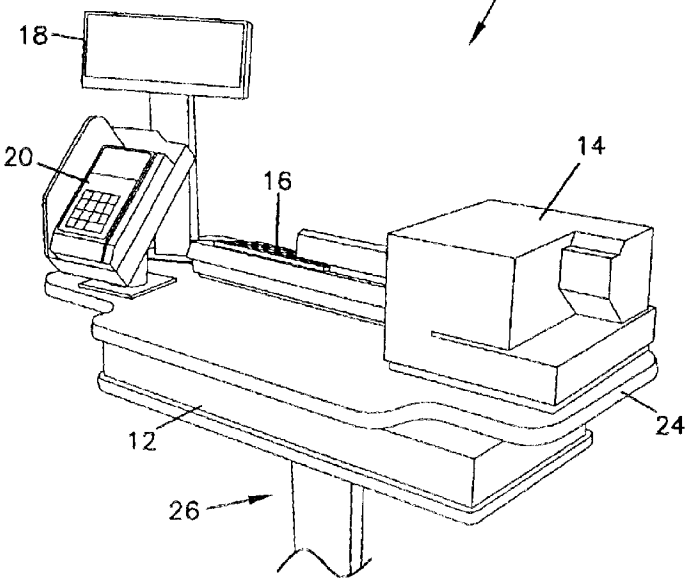
FIG. 2 is a perspective view of a second embodiment of a checkout stand podium assembly according to the present invention similar to that shown in FIG. 1, but viewed from the point of view of the customer.

The preferred embodiment of the invention is now described in detail with reference to the drawings, wherein like reference numerals represent like parts and assemblies throughout the several views.

Figure 1:
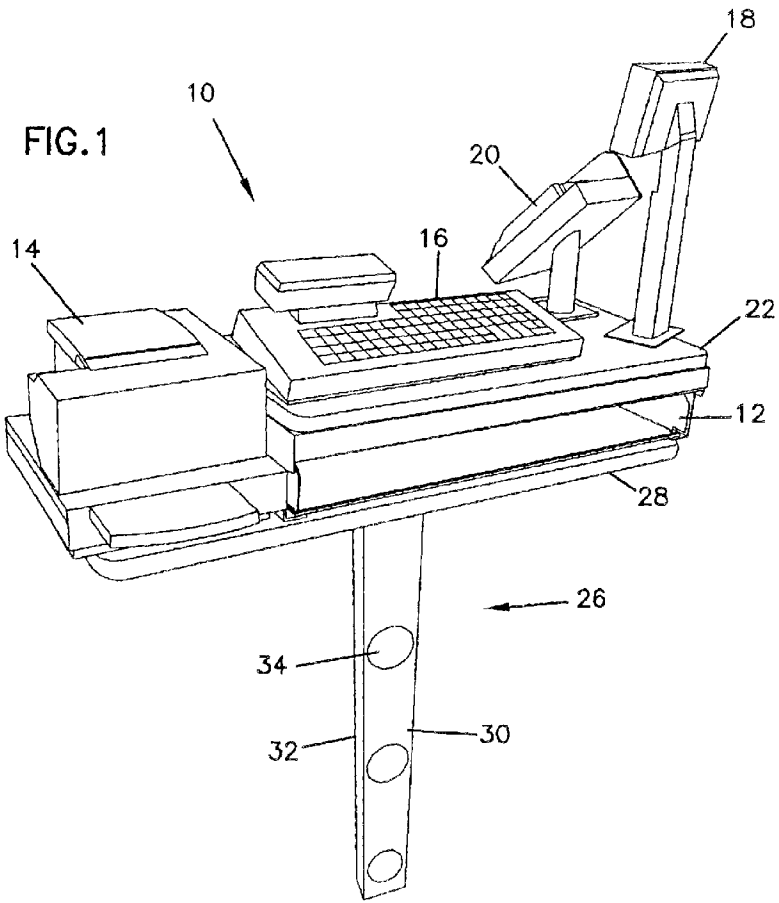
FIG. 1 is a perspective view of one embodiment of a checkout stand podium assembly according to the present invention, viewed from the point of view of the cashier, having various point-of-sale equipment thereon.
Figure 10:
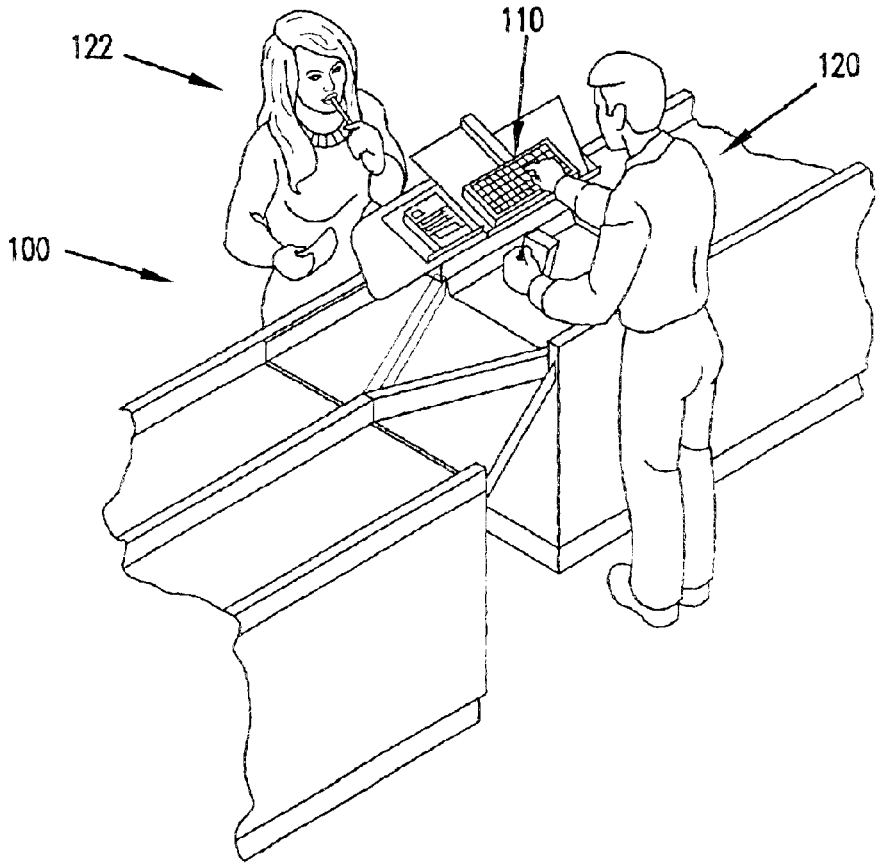
FIG. 10 is a general, perspective view of a checkout stand podium according to the present invention operable positioned between a cashier and a customer.

Referring to FIG. 1, a checkout stand podium assembly 10 is shown. Referring to FIG. 2, a checkout stand assembly 10' is shown. FIG. 1 shows podium assembly 10 from the perspective of the cashier, and FIG. 2 shows podium assembly 10' from the perspective as seen by the customer, assuming that podium assembly 10, 10' is positioned between the cashier and the customer in an area above or close to a scanning area having a barcode scanner. See, for example, FIG. 10, which generally illustrates a checkout stand 100 having a podium assembly 110 according to the present invention, in relation to cashier 120 and customer 122.

Each checkout podium assembly 10, 10' illustrated includes point-of-sale equipment such as a cash drawer 12, a printer 14, a keyboard 16, a display 18, and a credit card reader 20 (also referred to as a credit card swipe and pin pad machine), all supported on a podium 26. Podium assemblies 10, 10' are arranged so that cash drawer 12, printer 14 and keyboard 16 are facing the cashier, and display 18 and credit card reader 20 are facing the customer. It is understood that the peripheral equipment can be configured in any manner, and that additional or alternate types of peripheral equipment, such as a telephone, may be part of assembly 10, 10'.

In FIG. 1, keyboard 16, display 18 and credit card reader 20 are positioned on a tray 22 that is mounted over cash drawer 12. Tray 22 may also be referred to as a top, a shelf, or a topper. Positioned on tray 22 are keyboard 16, display 18, and credit card reader 20; printer 14 is positioned next to cash drawer 12 and not on tray 22. In FIG. 2, a second embodiment of a tray, tray 24 is shown, which is also mounted over cash drawer 12. Tray 24 is larger than tray 22 and provides a spot for all of keyboard 16, display 18, credit card reader 20, and printer 14. Tray 24 also provides an area that a customer can use as a check writing station. Tray 22 and tray 24 have numerous similar features, which will be discussed and compared below.

Figure 3:
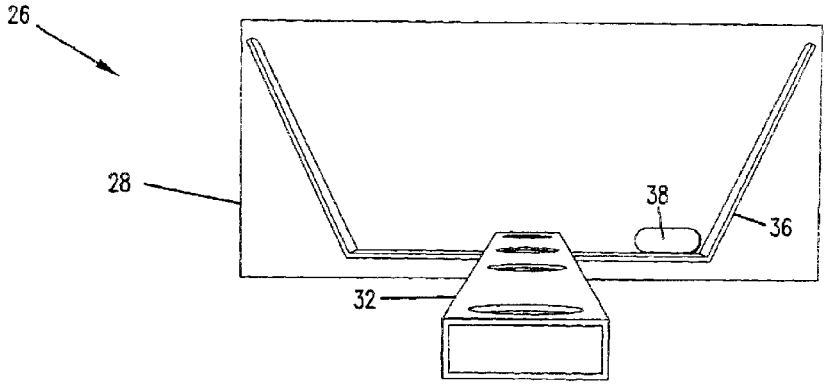
FIG. 3 is a bottom perspective view of the podium of FIGS. 1 and 2.

In FIG. 1, podium assembly 10 includes podium 26 supporting the various peripheral equipment. In particular, podium 26 supports cash drawer 12. Podium 26 is a structure having a drawer support structure, such as top or topper 28, and a support structure 30. Various features of podium 26 are also shown in FIG. 3. Topper 28 is a planer structure constructed to retain cash drawer 12 and any other equipment thereon. Any of numerous attachment mechanisms can be used to connect and retain cash drawer 12 onto topper 28. Preferably, cash drawer 12 is screwed or bolted directly onto topper 28. Other attachment mechanisms such as clips or adhesive could be used.

Topper 28 is held up or otherwise supported by support structure 30, which supports topper 28 and any equipment thereon without sagging or bending; support structure 30 has high flexural and torsional strength. In the embodiment illustrated, support structure 30 includes a leg 32 that is connected to and extends from topper 28 and that provides a means for mounting podium 26 onto the desired surface (such as a counter, floor, siderail, sidewall, etc.). Leg 32 is preferably a hollow rod or bar, or other hollow or channeled structure that provides sufficient support to topper 28 but that has a volume through which electronic cables and wires can pass. Apertures 34 are present in leg 32 to facilitate feeding and passing cables and wires through hollow leg 32. An exposed channel would generally be accessible the length of the channel. Leg 32 can be designed to be mounted on a horizontal surface, such as onto a counter surface or floor, or a vertical surface, such as a sidewall of a conveyor belt system, or on a structure such as a siderail. Podium 26 can be mounted at any area of leg 32; that is, it is not necessary that mounting occur at the end of leg 32 farthest from topper 28. It is understood that when podium 26 is operably mounted in a checkout stand, leg 32 is probably not be visible to the cashier or to the customer.

Referring to FIG. 3, podium 26 further includes a top or drawer support structure 36 connected to each of leg 32 and topper 28. Top support structure 36 provides increased flexural strength to topper 28 and minimizes the tendency for topper 28 to sag. Top support structure 36 is a generally U-shaped reinforcement that connects to leg 32 and extends under topper 28. It is understood that other shapes of top support structure 36 would be suitable.

Electronic cables or other wires that may pass through leg 32 can be passed through topper 28 via aperture 38 present in topper 28. The cables provide the electricity, data and other connections to operate peripherals such as display 18, keyboard 16 and credit card reader 20. Cash drawer 12 can also includes a matching or aligned aperture through which the cables and wires can pass through cash drawer 12.

Figure 5:
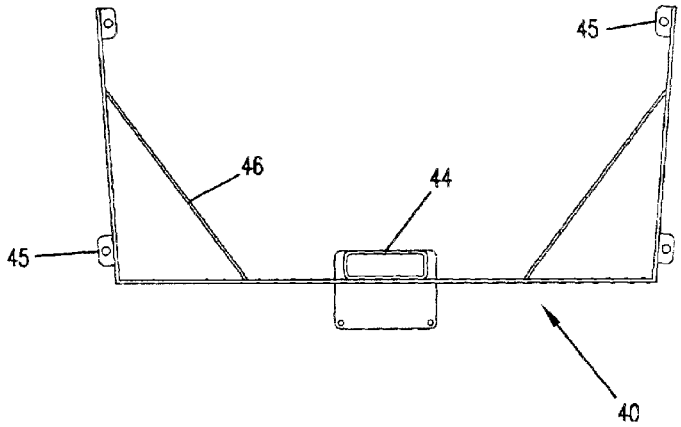
FIG. 5 is a top plan view of the podium of FIG. 4.
Figure 4:
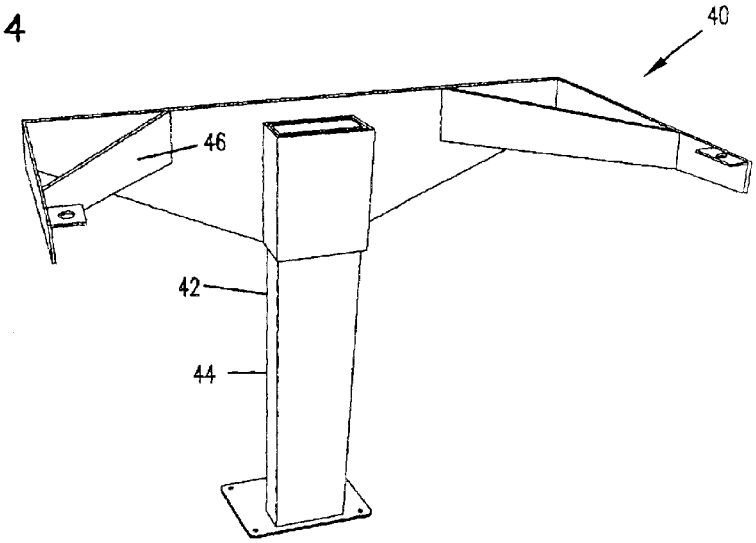
FIG. 4 is a front perspective view of a second embodiment of a podium according to the present invention.

A second embodiment of a podium stand is shown in FIGS. 4 and 5 as podium 40. Podium 40 is similar to podium 26, having a support structure 42 and a drawer support structure, except that the drawer support structure of podium 40 does not include a portion such as topper 28. Rather, podium 40 relies on support structure 42 to both provide an attachment of cash drawer 12 to support structure 42 and a means for mounting podium 40. Specifically, support structure 42 includes leg 44 and support 46, which can be referred to as a drawer support 46, because cash drawer 12 is mounted directly onto drawer support 46. Drawer support 46 is generally U-shaped, with angled portions to increase strength and rigidity, although other configurations of drawer support 46 are suitable. Cash drawer 12 can be directly attached to drawer support 46, for example by screws or bolts, such as through brackets 45. Leg 44 is similar to leg 32 of podium 26 in that leg 44 is a channel, hollow rod, or other structure through which electric cables and wires can be passed. Leg 44, as shown, is constructed for mounting to a counter or other base.

Podium 40 can be utilized in the same manner as podium 26. Podium 40 allows equipment such as cash drawer 12, printer 14, keyboard 16, display 18 and credit card reader 20 to be positioned at a location between the cashier and the customer, in an area close to or above the scanning area or zone.

Podium 26 can be constructed to be physically separable into support structure 30 and topper 28. Base support 36 may also be physically separable from support structure and topper 28, or be permanently connected to one or the other. Similarly, podium 40 can be constructed to be physically separable at leg 44 and drawer support 46. A set screw or other common system can be used to secure support structure 30 to topper 28 (for podium 26) and leg 44 to drawer support 46 (for podium 40) when assembled. A podium construction that can be broken down or disassembled facilitates packing and storage of the podium when not incorporated into a checkout stand assembly.

Cash drawer 12 can be one available from various commercial sources, or may be specifically designed for each individual application. For use with the assembly 10, 10' of the present invention, it is desired that cash drawer 12 has minimal front and back dimensions, and a minimal distance from front to back; in other words, a small cash drawer is desired. For use in any checkout assembly according to the present invention, cash drawer 12 is fairly low profile with a decreased thickness compared to conventional cash drawers, and cash drawer 12 preferably has a passage or other aperture therethrough to allow electronic cables and wires to pass from the bottom to the top of cash drawer 12.

Figure 6:
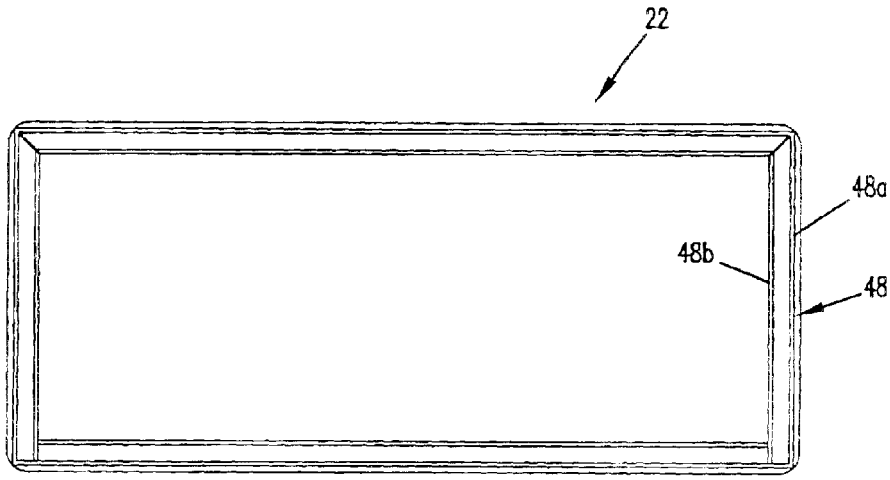
FIG. 6 is a bottom view of the topper shown in FIG. 1.
Figure 7:
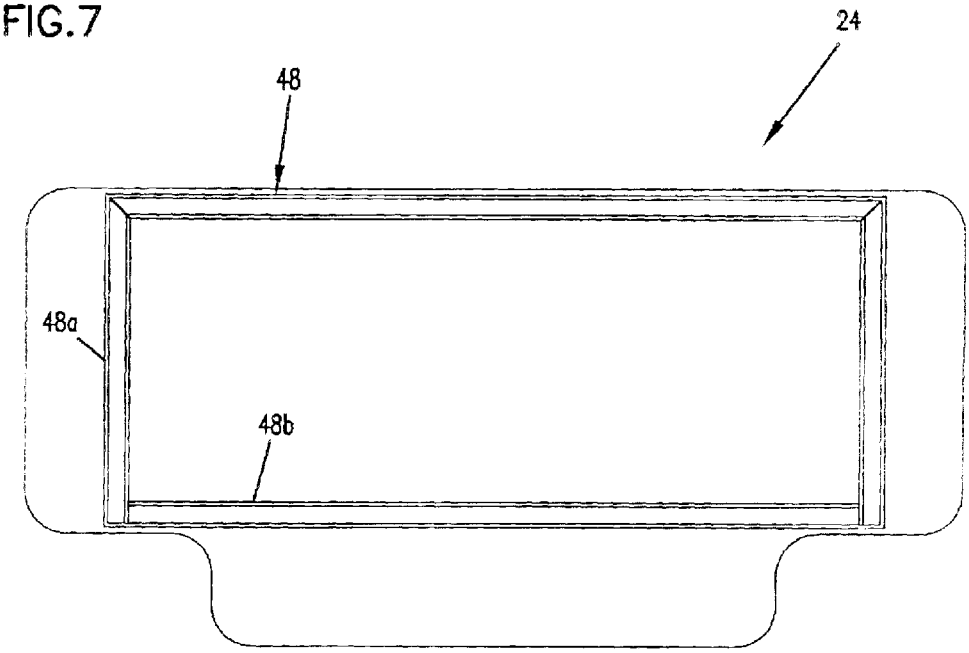
FIG. 7 is a bottom view of the topper shown in FIG. 2.

Two embodiments of trays for use with podiums 26, 40 and cash drawer 12 are shown in FIGS. 6 and 7. FIG. 6 illustrates tray 22, also shown in FIG. 1, and FIG. 7 shows tray 24, also shown in FIG. 2. Trays 22, 24, when operably installed to form a podium assembly 10, 10', are positioned on cash drawer 12. Each of trays 22, 24 are generally rectangular in shape and have a width and a depth. The width of trays 22, 24 is measured in the longitudinal direction, and, when operably installed in a checkout stand, is generally parallel to the product flow, whether over a counter or on the belts of a conveyor system. The width of trays 22, 24 extends along the front face of cash drawer 12. The depth of trays 22, 24 is measured in the direction from the front of cash drawer 12 to the customer. Preferably, the width of trays 22, 24 is greater than its depth. Tray 22 is a four-sided rectangular shape, having a width greater than the depth. Tray 24, however, is generally rectangular but having an additional outcropping in the depth direction along its width; this outcropping can function as a check writing area. Other shapes for trays are suitable.

The top surface of trays 22, 24, and any other tray, is constructed for supporting peripheral equipment thereon, equipment such as printer 14, keyboard 16, display 18, credit card reader 20, and other peripherals. This top surface is generally planar and flat, but may include preformed depressions or ledges on which to place the peripherals. In some embodiments, topography may be added to optimize the arrangement of the peripherals; for example, a wedge may be added to provide a tilt to keyboard 16.

The bottom side of trays 22, 24 is shown in FIGS. 6 and 7, respectively. Each of tray 22, 24 includes a cable management system 48 that retains and organizes the wires and cables that run through the support structure of the podium, such as leg 32 of podium 26 and leg 44 of podium 40, and up through cash drawer 12. Cable management system 48 keeps the wires and cables neatly arranged within a channel, trough or similar construction so that the cables and wires are neatly organized and hidden from view. This also keeps mischievous customers or curious children from tugging or pulling on exposed wires or cables. The wires and cables are retained by cable management system 48 between outer wall 48*a* and inner wall 48*b*. Outer wall 48*a* can also provide the alignment to retain tray 22, 24 onto cash drawer 12. Preferably, outer wall 48*a* seats on and encompasses cash drawer 12, preferably with a tight friction fit.

Various holes or apertures can be provided in trays 22, 24 to allow cables and wires to go directly to the desired peripheral from cable management system 48. Cable management system 48 is, in essence, a cable manifold, that takes wires or cables from a source and divides them as needed.

Outer wall 48*a* of cable management system 48 may be present at the outermost edge of tray 22, 24, or outer wall 48*a* may be distanced inward from the edge or edges, as in the embodiments shown. The size of tray 22, 24 can be adjusted to be the same as, similar to, or significantly larger than cash drawer 12 on which tray 22, 24 is positioned. The exact size of tray 22, 24 is a matter of choice, but should be sufficiently large to support all desired equipment.

Figure 8:
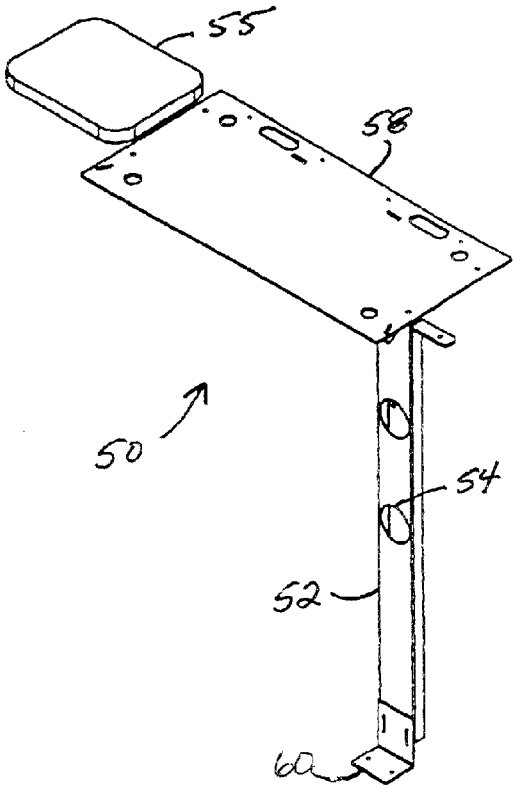
FIG. 8 is a top perspective view of a third embodiment of a checkout stand podium according to the present invention.
Figure 9:
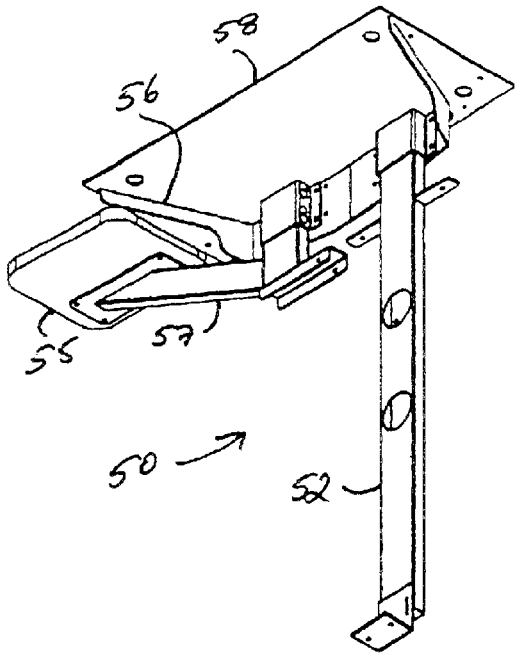
FIG. 9 is a bottom perspective view of podium of FIG. 8.

Another embodiment of a podium according to the present invention is shown in FIGS. 8 and 9 as podium 50. Similar to podiums 26, 40 described above, podium 50 has a support structure (that includes leg 52 having apertures 54 therein) and top 58. Similar to podiums 26, 40, top 58 is constructed to receive a cash drawer thereon. Also included is a base support structure 56, which increases torsional stability and decreases bending and flexing of top 58. Podium 50 includes an auxiliary tray 55, which is located adjacent yet remote from top 58 and is supported by arm 57. Tray 55 can be used for check writing by the customer. In the embodiment illustrated, the position of tray 55 and top 58 can be interchanged, thus changing a right-handed tray to a left handed tray. Podium 60 further includes a bracket 60 for mounting podium 50 to a vertical or horizontal surface. In the embodiment illustrated, podium 50 is adapted for mounting to a horizontal surface.

Each of podium 26, 40, 50 is sufficiently rigid and substantial in size to adequately accommodate any foreseen uses. For example, podium 26, 40, 50 should be sufficiently rigid and sturdy to accept the high level or activity of the opening and closing of cash drawer 12. All of topper 28, 58, support structure 30, 42, base support structure 36, 46, 56 should be sufficiently rigid and strong to adequately support the structure, any peripheral equipment, and any extra weight that may be placed on podium 26, 40, 50, such as a heavy purse or a customer leaning on the top. Topper 28, 58 can be any material, such as metal (aluminum, steel, iron), polymeric material, ceramic, composite, wood or any other suitable material. Similarly, support structures 30, 42 (e.g., leg 32, 44, 52) can be any material, such as metal (aluminum, steel, iron), polymeric material, ceramic, composite, wood, or any other suitable material. Typically, support structures 30, 42 will be metal. It is foreseen that in some constructions, different materials may be used for the top, the support structure, and/or the base support structures. In one embodiment, the entire structure of podium 26, 40, 50 is made from steel. Similarly, any material can be used for tray 22, 24. Typical and well known manufacturing techniques can be used for manufacturing podium 26, 40, 50 and the various parts. It is understood that the technique used will depend on the material used.

The above specification, examples and data provide a complete description of the manufacture and use of the composition of the invention. Since many embodiments of the invention can be made without departing from the spirit and scope of the invention, the invention resides in the claims hereinafter appended.

What is claimed:

1. A store checkout stand assembly for operably mounting between a cashier and a customer at a point-of-sale, comprising:

(a) a podium comprising:

(i) a drawer support comprising a U-shaped member; and (ii) a support structure extending from a mounting surface to the drawer support, the support structure having a channel therein extending from the mounting surface to the drawer support for accepting cables therethrough; and (b) a cash drawer operably mounted on the drawer support.

2. The checkout stand assembly according to claim 1, wherein the drawer support further comprises a topper, the cash drawer operably mounted on the topper.

3. The checkout stand assembly according to claim 1, wherein the support structure is permanently affixed to the drawer support.

4. The checkout stand assembly according to claim 1, wherein the podium further includes a tray remote from the drawer support.

5. The checkout stand assembly according to claim 1, wherein the support structure comprises a leg.

6. The checkout stand assembly according to claim 5, wherein at least a portion of the leg is hollow, and the leg comprises apertures therein for access to the channel.

7. The checkout stand assembly according to claim 1, further comprising a tray mounted on the cash drawer opposite the drawer support.

8. The checkout stand assembly according to claim 7, wherein the tray is sized to support a keyboard, a credit card reader, and a display monitor.

9. The checkout stand assembly according to claim 8, wherein the tray is sized to further support a printer.

10. The checkout stand assembly according to claim 7, wherein the tray includes a check writing area.

11. The checkout stand assembly according to claim 7, wherein the fray includes a cable manifold system for accepting lengths of cables or wires.

* * * * *

UNITED STATES PATENT AND TRADEMARK OFFICE

CERTIFICATE OF CORRECTION

PATENT NO. : 6,834,596 B2
DATED : December 28, 2004
INVENTOR(S) : Kerber

It is certified that error appears in the above-identified patent and that said Letters Patent is hereby corrected as shown below:

Title page,
Item [56], References Cited, U.S. PATENT DOCUMENTS, "5/1933 Friedemann" should read -- 6/1933 Friedmann --

Column 8,
Line 11, "wherein the fray" should read -- wherein the tray --

Signed and Sealed this

Fourteenth Day of June, 2005

JON W. DUDAS
*Director of the United States Patent and Trademark Office*